United States Patent [19]

Hasegawa

[11] 4,115,874

[45] Sep. 26, 1978

[54] HELMET FOR USE IN RIDING VEHICLES

[76] Inventor: Masahiro Hasegawa, 1-11-12, Nishiazabu, Minato-ku, Tokyo, Japan

[21] Appl. No.: 833,413

[22] Filed: Sep. 15, 1977

[30] Foreign Application Priority Data

| | | | |
|---|---|---|---|
| Feb. 21, 1977 | [JP] | Japan | 52-19992[U] |
| Apr. 7, 1977 | [JP] | Japan | 52-42587[U] |
| May 30, 1977 | [JP] | Japan | 52-70501[U] |

[51] Int. Cl.[2] ..... A42B 3/02

[52] U.S. Cl. ..... 2/425; 2/171.3

[58] Field of Search ..... 2/425, 424, 171.3, 410, 2/411, 412, 414, 415

[56] References Cited

U.S. PATENT DOCUMENTS

| | | | |
|---|---|---|---|
| 3,223,086 | 12/1965 | Denton | 2/410 X |
| 3,496,854 | 2/1970 | Feldmann et al. | 2/410 X |
| 3,860,966 | 1/1975 | Brown et al. | 2/415 |
| 3,925,821 | 12/1975 | Lewicki | 2/425 |
| 4,054,953 | 10/1977 | DeBarsy | 2/425 X |

*Primary Examiner*—Dorsey Newton

*Attorney, Agent, or Firm*—Lawrence I. Field

[57] ABSTRACT

A helmet for use in riding vehicles such as motorcycles, motorbikes, etc. comprises a cap like body made of hard material, a bumping body applied on an inner surface of the cap like body, a number of streamline recesses formed in the bumping body and extending from a forehead portion to a backhead or side portion of the cap like body. When a user wears the helmet, the air stream flows through the recesses from the front openings to the rear openings of the recesses and thus the temperature and humidity inside the helmet are decreased.

3 Claims, 27 Drawing Figures

HELMET FOR USE IN RIDING VEHICLES

BACKGROUND OF THE INVENTION

The present invention relates to a helmet for use in riding vehicles such as motorcycles, motorbikes and the like.

Nowadays from a view point of safety one who rides motorcycles or motorbikes has a legal obligation to wear a helmet. In general known helmets are not designed to conduct an air stream inside the helmets. Thus particularly in summer a temperature inside the helmet is liable to increase and a head of the user gets moist. Therefore even if the user wears the helmet for a short time, the user feels uncomfortable. It has been known that a safety cap or helmet for general use has several small holes in its top portion so as to conduct an air stream through these holes by means of natural draught. However such a known construction could not be applied to the helmet for use in riding the motorcycles, because this type of helmet is used to be closely in contact with the head of the user and thus the natural draught effect could not be expected so much.

SUMMARY OF THE INVENTION

The present invention has for its object to provide a novel helmet for use in riding vehicles such as motorcycles and motorbikes which can obviate the above mentioned drawbacks of the known helmets by conducting an air stream inside the helmet utilizing a wind pressure during the travelling or driving.

A helmet for use in riding vehicles according to the invention comprises a cap like body, a bumping body applied on the inner surface of the cap like body, a plurality of streamline recesses formed in the outer surface of the bumping body and extending from a forehead portion to a backhead or side portion of the helmet, inlet means provided at the forehead portion of the helmet and communicated with the recesses for taking the air stream inside the helmet, and outlet means provided at the backhead or side portion of the helmet and communicated with the recesses for discharging the air stream, whereby the air stream introduced through the inlet means flows through the recesses and is discharged through the outlet means.

BRIEF DESCRIPTION OF THE DRAWINGS

FIG. 12 (*b*) is a cross section showing inlet means of the helmet of FIG. 12 (*a*);

FIG. 13 (*b*) is a cross section illustrating outlet means of the helmet of FIG. 13 (*a*);

FIGS. 15 (*b*), 16 (*a*), 16 (*b*), 17 (*a*), 17 (*b*), 18 and 19 are partial perspective views and cross sections showing five embodiments of the inlet means according to the invention.

DESCRIPTION OF THE PREFERRED EMBODIMENTS

Figure 1:
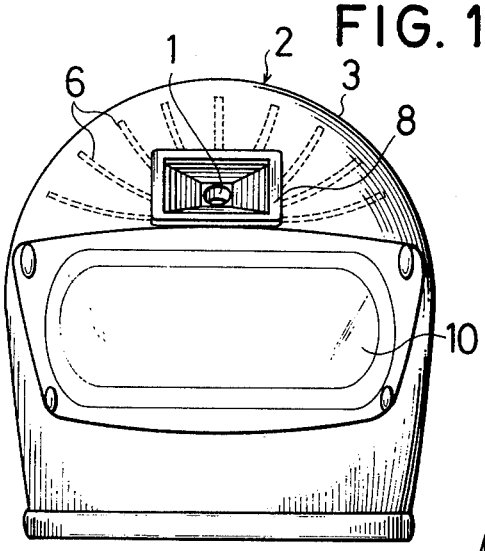
FIG. 1 is a front view of a first embodiment of a helmet according to the invention.
Figure 2:
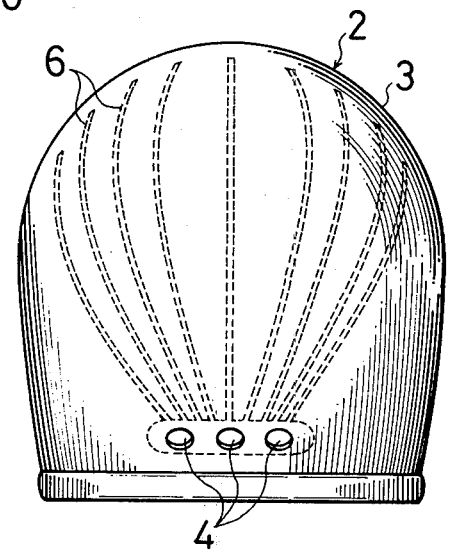
FIG. 2 is a rear view of the helmet of FIG. 1.
Figure 3:
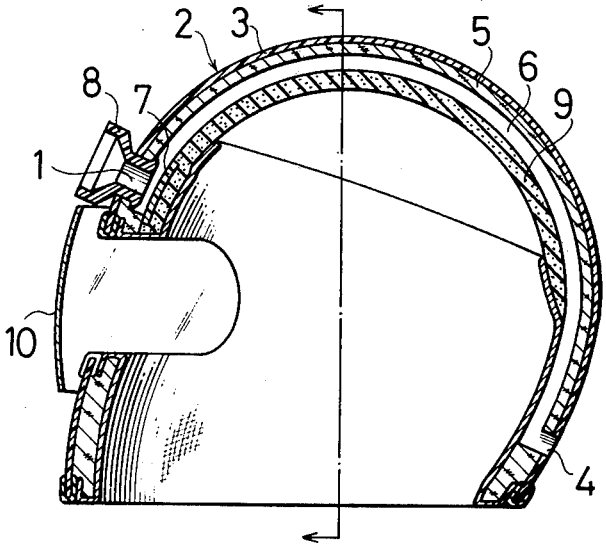
FIG. 3 is a cross section taken along a plane perpendicular to a plane of FIG. 1.
Figure 4:
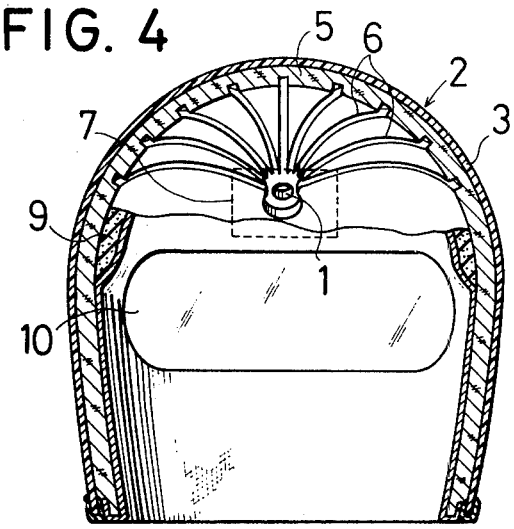
FIG. 4 is a cross section taken along a plane parallel to the plane of FIG. 1.

FIGS. 1 to 4 show a first embodiment of the helmet according to the invention. This helmet generally denoted by a reference numeral 2 comprises a cap like body 3 made of hard material. At a forehead portion of the cap like body 3 there is formed an inlet 1 and at a backhead portion of the cap like body 3 there are formed outlets 4. The inner surface of the cap like body 3 is covered with a bumping body 5 made of foamed polystyrene or cork. The inlet 1 and outlets 4 communicate with each other by means of a plurality of elongated recesses 6 formed in the outer surface of the bumping body 5. These recesses 6 have streamline configuration so as to conduct an air stream smoothly from the inlet 1 to the outlets through the recesses. On inner surfaces of the portions of the recesses 6 which are situated directly behind the inlet 1 is arranged a shielding plate 7 which prevents the air stream from flowing directly inside the helmet and insures that air stream is forced to flow through the recesses 6. In the present embodiment in order to collect efficiently outside air into the helmet 2 there is arranged in front of the inlet 1 a wind collecting device 8 having an angularly tapered shape. Further on the bumping body 5 there is arranged a sheet like member 9 for absorbing vibration and this member 9 is made of sponge like material having an air draught property. A transparent window 10 is rotatably and/or detachably secured to the cap like body 3. Since the wind collecting device 8 might injure the face of the user upon falling down violently it is preferable to make the device 8 of resilient material such as rubber.

When the driver rides the motorcycle or motorbike while wearing the helmet of the embodiment described above the outside air is taken into the helmet through the inlet 1 at the forehead portion by the wind pressure and the introduced air stream flows through the recesses 6 almost without being subjected by resistance and is discharged through the outlets 4. During the air stream passing through the recesses 6 the space inside the helmet is communicated with the air stream in the recesses 6 through the sponge layer 9, so that the inside space does not become to be at high temperature and high humidity. Particularly by arranging the wind collecting device 8 at the inlet 1 it is possible to decrease a diameter of the inlet 1 and to take in the air stream with a higher efficiency. Therefore the effect of decreasing the temperature and humidity inside the helmet is materially increased.

The sponge layer 9 lined on the outer surface of the bumping body 5 may be dispensed with, if desired. Then the bumping body 5 having the recesses 6 formed therein will exist directly inside the helmet 2. The wind collecting device 8 may be formed in any suitable shape such as trumpet-shape. Further the wind collecting device 8 may be detachably fixed to the cap like body 3. In such a construction the device 8 can be removed at will and particularly in rain the inlet 1 may be closed by a suitable plug so as to prevent rain drops from being introduced into the helmet 2.

Figure 5:
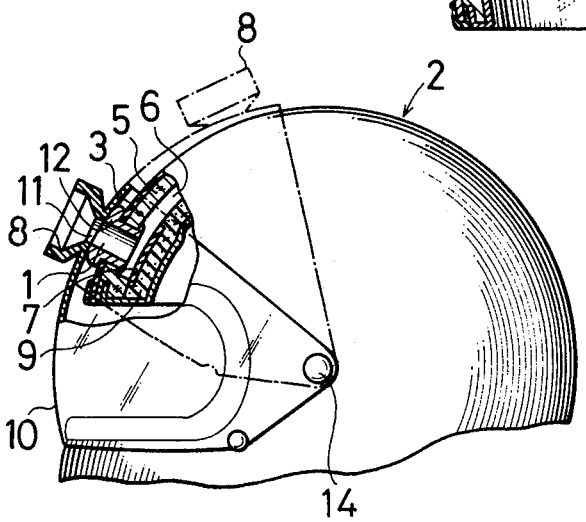
FIG. 5 is partially cross sectional side view showing a second embodiment of the helmet according to the invention.

FIG. 5 is a partially cross sectional view illustrating a second embodiment of the helmet according to the invention. In the first embodiment just explained above since the wind collecting device 8 extends from the forehead portion of the cap like body 3 when the transparent window 10 is opened by rotating it upwards it is necessary to take off the wind collecting device 8. In the second embodiment a wind collecting device 8 is fixedly arranged at an upper portion of a transparent window 10 which is made longer in the up and down direction. In a closed position of the window 10 a small hole 11 formed in the wind collecting device 8 is in communication with the inlet 1 formed in the cap like body 3. In the inlet 1 there is inserted a ring 12 of resilient material such as rubber which is urged against the rear surface of the window 10. Thus the air introduced through the wind collecting device 8 does not leak out through a junction between the wind collecting device 8 and the inlet 1. In the present embodiment the window 10 can be freely moved upwards or downwards about a pivot 14 without being prevented by the wind collecting device 8.

Figure 6:
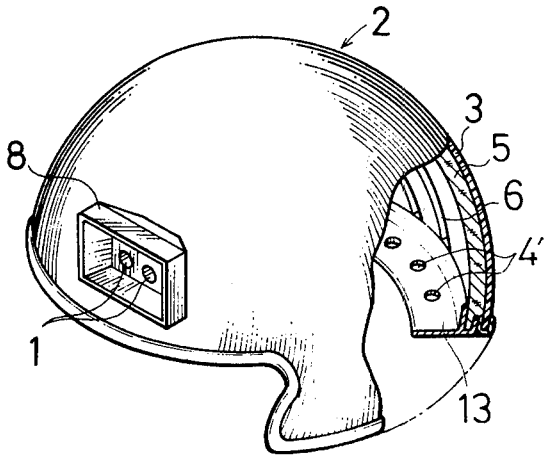
FIG. 6 is a partially cut away perspective view illustrating a third embodiment of the helmet of the invention.

FIG. 6 shows a third embodiment of the helmet according to the invention which is a comparatively shallow type. In this embodiment instead of forming the outlet at the rear portion of the cap like body 3 several outlets 4' are formed in a cloth or flange portion 13 which surrounds the neck of the user when the user wears the helmet. Further at the forehead portion of the cap like body 3 there are formed two inlets 1. The operational effect of the helmet according to this third embodiment is substantially same as that of the preceding embodiments.

Figure 7:
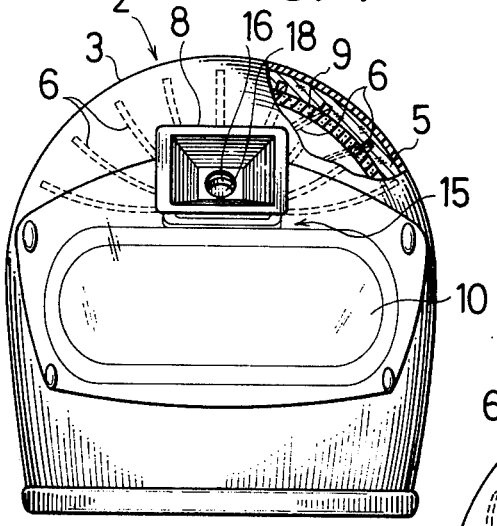
FIG. 7 is a partially cut away front view depicting a fourth embodiment of the helmet according to the invention.
Figure 8:
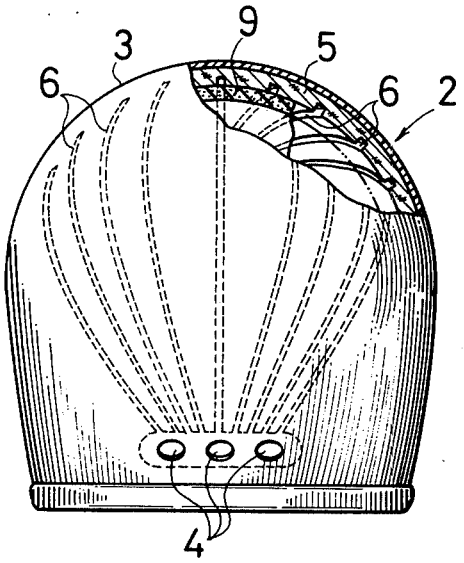
FIG. 8 is a partially cut away rear view of the helmet of FIG. 7.
Figure 9:
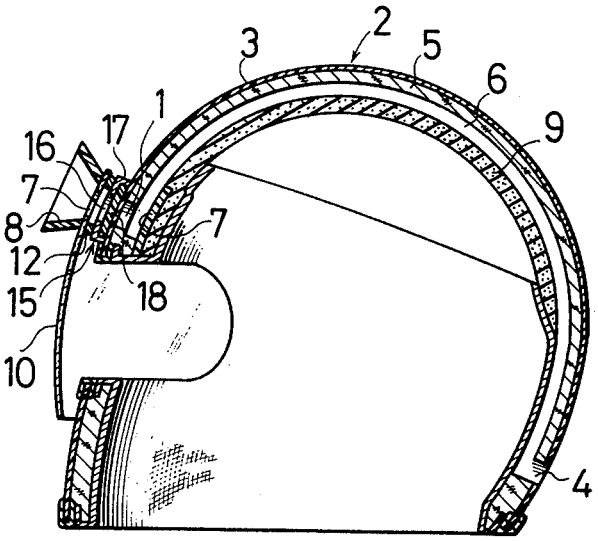
FIG. 9 is a cross section taken along a plane perpendicular to the plane of FIG. 7.
Figure 10:
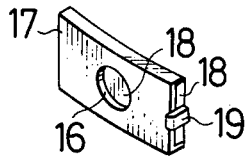
FIGS. 10 (*a*) and (*b*) are perspective views showing a window construction.
Figure 10:
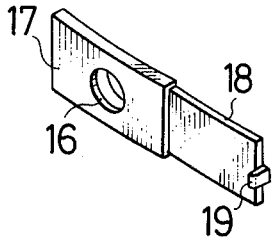

FIGS. 7 to 9 show a fourth embodiment of the helmet according to the invention. This embodiment is similar to the second embodiment shown in FIG. 5. In the second embodiment the inlet 1 could not be easily blocked in the closed position of the transparent window 10 and thus upon driving in rain rain drops might enter into the helmet 2 or upon driving in winter cold wind might enter into the helmet 2. The fourth embodiment can obviate such drawbacks by proving a window 15 between the wind collecting device 8 and the inlet 1. As shown in FIGS. 10 (*a*) and 10 (*b*) the window 15 includes a cover 17 secured to the cap like body 3 at the position of the inlet 1, which cover has a through hole 16 having the same diameter as that of the inlet 1 and a shielding plate 18 slidably arranged between the cover 17 and the cap like body 3. The shielding plate 18 does not move freely owing to a suitable friction and can only be slid by an external force. At one end of the plate 18 is provided with a projection 19 which serves as a knob and a stopper. In this embodiment the shielding plate 15 is slid after removing the transparent window 10. It may be possible to design such a construction that the shielding plate is moved without removing the window 10.

In this embodiment when the window 15 is opened, the air flows into the helmet 2 through the inlet 1 provided at the forehead portion of the helmet 2 and the air stream flows through the recesses 6 and then discharges through the outlet 4 provided at the rear portion of the helmet 2. Thus the temperature and humidity inside the helmet 2 do not increase. Moreover in rain or winter when the window 15 is closed rain drops or cold air are prevented from entering into the helmet 2.

Figure 11:
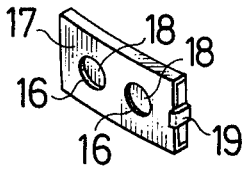
FIGS. 11 (*a*), (*b*) and (*c*) are perspective views illustrating another embodiment of the window construction.
Figure 11:
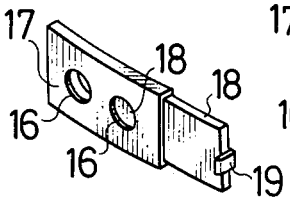
Figure 11:
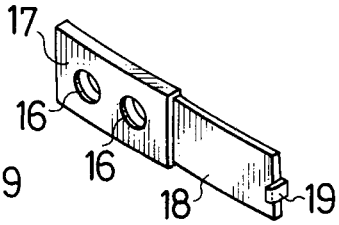

FIGS. 11 (*a*), 11 (*b*) and 11 (*c*) show another embodiment of the window construction which is used for a helmet having two inlets 1 at the forehead portion of the cap like body 3. For this purpose there are formed two holes 16 in the cover 17 which communicate with the two inlets 1 of the cap like body 3. In such a construction when the shielding plate 18 is pulled out to a first position shown in FIG. 11 (*b*) one of the holes 16 is opened and the other is closed and when the shielding plate 18 is further pulled out to a second position illustrated in FIG. 11 (*c*) the both holes 16 are opened. In this manner an amount of air introduced into the helmet 2 can be adjusted.

The window 15 for the inlet 1 is not necessarily provided on the outer surface of the cap like body 3. For example the window may be provided on the inner surface of the cap like body 3 and the shielding plate 18 may be moved by a suitable lever. Moreover the outlets 4 provided at the rear portion of the helmet may be selectively closed. By this measure the shielding effect of the window 15 can be further increased.

According to a further aspect of the invention the air stream can be introduced into the helmet without providing the inlet at the forehead portion of the cap like body. The following embodiments are constructed on the basis of such an aspect.

Figure 12:
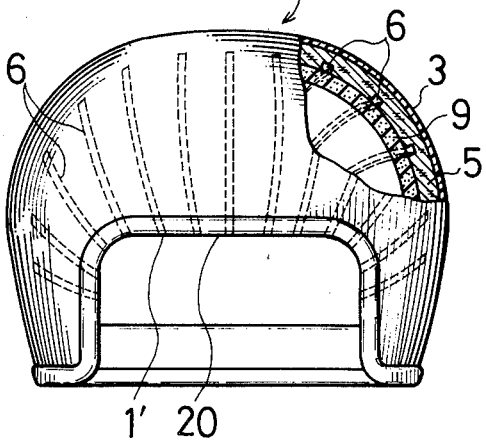
FIG. 12 (*a*) is a partially cut away front view illustrating a fifth embodiment of the helmet according to the invention.
Figure 12:
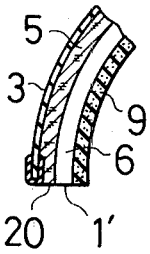
Figure 13:
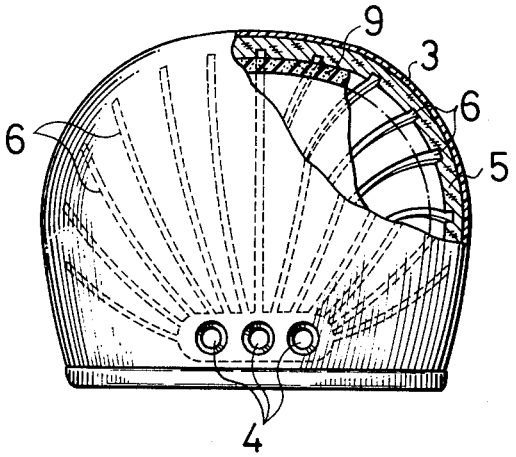
FIG. 13 (*a*) is a partially cut away rear view of the helmet shown in FIG. 12 (*a*)
Figure 13:
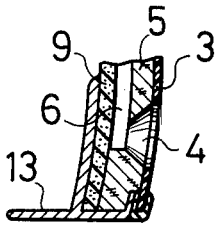

FIGS. 12 (*a*), 12 (*b*), 13 (*a*) and 13 (*b*) illustrate a fifth embodiment of the helmet according to the invention. In this embodiment a plurality of air conducting recesses 6 are opened at an edge 20 of the forehead portion of the helmet 2. As shown in FIG. 13 (*a*) the recesses 6 communicate with outlets 4 provided on the rear portion of the cap body 3. In this embodiment the outlets 4 are tapered as shown in FIG. 13 (*b*).

When the user rides motorcycles or motorbikes while wearing such a helmet there is produced a reduced pressure near the outlets 4 at the rear portion of helmet 2 and thus the air inside the helmet is discharged through the outlets 4. At the same time outside air is introduced into the recesses 6 through the openings 1' provided at the edge 20 of the forehead portion of helmet 2. Therefore inside the helmet 2 the air stream flows through the recesses 6 from the forehead side to the rear side, so that the temperature and humidity inside the helmet do not increase. The outlets 4 may be formed at the side portion of the cap like body 3.

Figure 14:
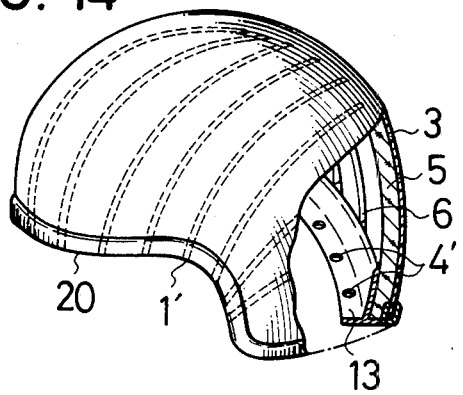
FIG. 14 is a partially cut away perspective view showing sixth embodiment of the helmet according to the invention.

FIG. 14 illustrate another embodiment of the helmet according to the invention. In this embodiment several outlets 4' are provided in a flange 13 which surrounds the neck of the user. In such a construction it is possible to flow the air stream through the recesses 6.

Figure 15:
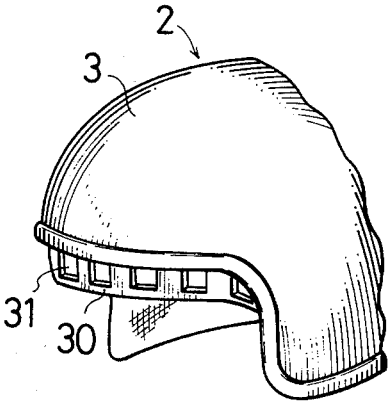
FIG. 15 (*a*) is a partial perspective view depicting a seventh embodiment of the helmet according to the invention.
Figure 15:
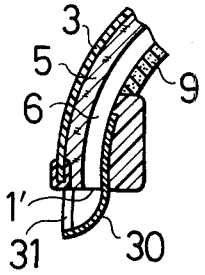

FIGS. 15 (*a*) to 19 show several embodiments in which means for introducing the air inside the helmet 2 with a high efficiency are provided. In an embodiment illustrated in FIGS. 15 (*a*) and 15 (*b*) a wind collecting device 30 having several holes 31 is provided at an edge 20 of the forehead portion of the helmet 2. In this embodiment the wind collecting device 30 has a visor like shape. By providing such a device 30 at the forehead portion the outer air can be efficiently introduced into the openings 1' of the recesses 6.

Figure 16:
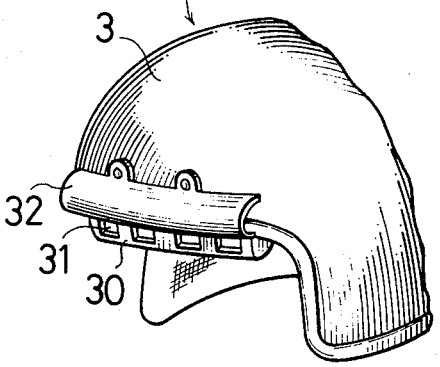
Figure 16:
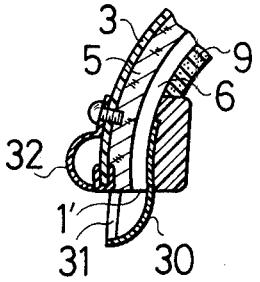

FIG. 16 (*a*) and 16 (*b*) illustrate another embodiment of the helmet 2 according to the present invention. In this embodiment on the forehead portion of the cap like body 3 is secured a wind regulating device 32 having a semicircular cross section. By providing such a device 32 the efficiency of the wind collecting device 30 is increased.

Figure 17:
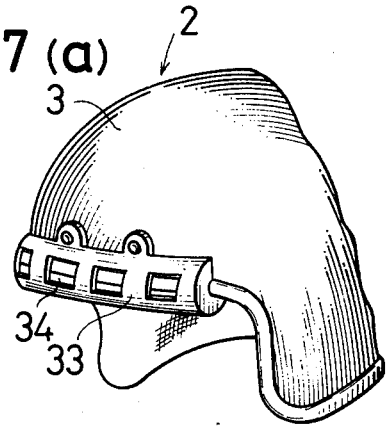
Figure 17:
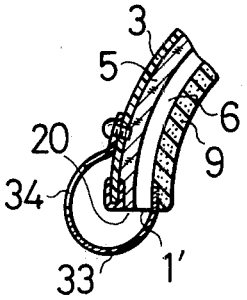

FIGS. 17 (*a*) and 17 (*b*) depict a further embodiment of the wind collecting device. In this embodiment a cylindrical wind collecting device 33 having several wind inlets 34 communicated with the openings 1' of the recesses 6 are provided at the edge 20 of the forehead portion of the helmet 2.

Figure 18:
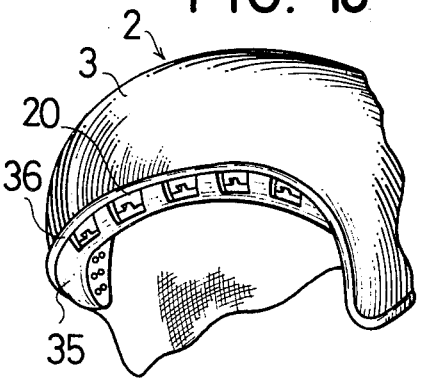

In an embodiment shown in FIG. 18 a pad body 35 secured on an inner surface of the forehead edge 20 of the helmet 2 have several wind inlets 36 communicated with the recesses 6 formed therein.

Figure 19:
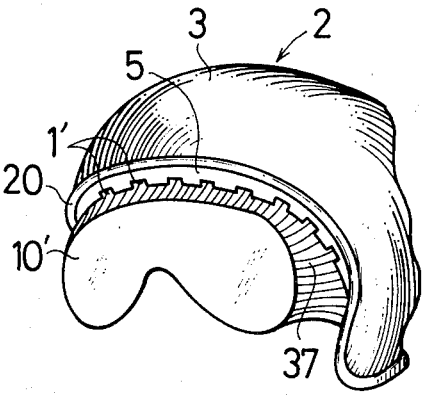

FIG. 19 illustrates a further embodiment of the helmet 2 according to the invention. In this embodiment a goggles 10' is connected to a bumping member 5 of the helmet 2 by means of a skirt member 37 having a number of corrugations. The air is introduced into the helmet 2 through the openings 1' of the recesses 6.

It should be noted that the present invention is not limited to the embodiments explained above and many modifications are possible within the scope of the invention. For example in the embodiments illustrated in FIGS. 12 to 19 the openings 1' or holes 31 may be closed in rain or winter by means of suitable window constructions.

What is claimed is:

1. A helmet for use in riding vehicles such as motorcycles and motorbikes comprising:

a cap like body formed of hard and solid material;

a bumping body applied on an inner surface of the cap like body; and a plurality of uninterrupted streamline recesses formed in an outer surface of the bumping body and extending completely from a forehead edge portion to a backhead edge portion of the helmet.

2. A helmet according to claim 1, further comprising a wind collecting device which is provided at the forehead edge portion of the cap like body and is in communication with front openings of said recesses.

3. A helmet according to claim 1, further comprising a flange which is provided around the rearhead edge of the cap like body and surrounds the neck of a user when the user wears the helmet and a plurality of holes formed in said flange.

* * * * *